US012044406B2

(12) United States Patent
Neal et al.

(10) Patent No.: US 12,044,406 B2
(45) Date of Patent: Jul. 23, 2024

(54) MINIMUM IGNITION PERIOD FOR GAS BURNERS

(71) Applicant: Midea Group Co., Ltd., Foshan (CN)

(72) Inventors: Vern A. Neal, Louisville, KY (US); Richard W. Cowan, Louisville, KY (US); John Kenneth Hooker, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 406 days.

(21) Appl. No.: 17/490,172

(22) Filed: Sep. 30, 2021

(65) Prior Publication Data

US 2023/0095549 A1 Mar. 30, 2023

(51) Int. Cl.
*F23N 5/20* (2006.01)
*F23N 5/12* (2006.01)

(52) U.S. Cl.
CPC ..... *F23N 5/206* (2013.01); *F23N 5/126* (2013.01); *F23N 2223/30* (2020.01); *F23N 2227/28* (2020.01); *F23N 2241/08* (2020.01)

(58) Field of Classification Search
CPC .. F23N 5/126; F23N 2241/08; F23N 2223/30; F23N 2227/28; F23N 1/005; F24C 3/124; F24C 3/128; F24C 3/10; G05G 1/105
USPC ..... 431/66
See application file for complete search history.

(56) References Cited

U.S. PATENT DOCUMENTS 3,529,584 A 9/1970 Celaya
4,681,084 A 7/1987 Grech
5,094,259 A 3/1992 Hsu
5,787,874 A 8/1998 Krohn et al.
6,619,613 B1 9/2003 Akamatsu et al.
7,428,901 B2 9/2008 Gama et al.
7,527,072 B2 5/2009 Crnkovich
7,568,909 B2 8/2009 MacNutt et al.
8,100,121 B2 1/2012 Clauss et al.
(Continued)

FOREIGN PATENT DOCUMENTS

CN 104500830 4/2015
CN 204459413 7/2015
(Continued)

OTHER PUBLICATIONS

United States Patent and Trademark Office, Final Office issued in U.S. Appl. No. 17/111,929, 23 pages, dated Nov. 9, 2022.
(Continued)

*Primary Examiner* — Vivek K Shirsat
(74) *Attorney, Agent, or Firm* — Gray Ice Higdon

(57) ABSTRACT

A cooking appliance includes: a gas cooking element; an igniter disposed adjacent to the gas cooking element to ignite the gas cooking element; a gas valve for regulating gas flow to the gas cooking element; a burner control mechanically coupled to the gas valve to vary the gas flow to the gas cooking element; a sensor for detecting the positioning of the burner control in an ignition range of positions; and a control circuit coupled to the igniter and the sensor and to activate the igniter in response to detected movement of the burner control into the ignition range of positions, the control circuit further configured to maintain activation of the igniter for a predetermined minimum length of time once activated.

15 Claims, 5 Drawing Sheets

(56) References Cited

U.S. PATENT DOCUMENTS

| | | | | |
|---|---|---|---|---|
| 8,766,116 | B2 | 7/2014 | Barrena et al. | |
| 9,004,058 | B1 | 4/2015 | Brown | |
| 9,068,752 | B2 | 6/2015 | Shaffer et al. | |
| 9,709,284 | B2 | 7/2017 | Bach et al. | |
| 9,746,186 | B2 | 8/2017 | Moro et al. | |
| 9,765,966 | B2 | 9/2017 | Herzog | |
| 10,344,984 | B2 | 7/2019 | Golomb | |
| 10,504,673 | B2 * | 12/2019 | Cha | H01H 19/14 |
| 11,441,782 | B2 | 9/2022 | Cowan | |
| 2002/0073985 | A1 * | 6/2002 | Leukhardt, III | F23N 5/102 431/78 |
| 2010/0216080 | A1 | 8/2010 | Home | |
| 2010/0253653 | A1 | 10/2010 | Stambaugh et al. | |
| 2012/0247452 | A1 | 10/2012 | Pianezze | |
| 2012/0285243 | A1 | 11/2012 | Yamamoto | |
| 2013/0260320 | A1 | 10/2013 | Townsend | |
| 2014/0001173 | A1 | 1/2014 | Holzgreve | |
| 2015/0037737 | A1 | 2/2015 | Pottenger et al. | |
| 2015/0193073 | A1 | 7/2015 | Dmytriw et al. | |
| 2016/0348916 | A1 * | 12/2016 | French | F23N 1/007 |
| 2017/0238751 | A1 | 8/2017 | Vengroff | |
| 2018/0245795 | A1 | 8/2018 | Serabatir | |
| 2020/0011534 | A1 | 1/2020 | Park et al. | |
| 2020/0103110 | A1 | 4/2020 | Buescher et al. | |
| 2022/0178538 | A1 | 6/2022 | Cowan et al. | |
| 2022/0178547 | A1 | 6/2022 | Cowan et al. | |

FOREIGN PATENT DOCUMENTS

| | | |
|---|---|---|
| CN | 206648088 | 11/2017 |
| CN | 108019800 | 5/2018 |
| GB | 1493580 | 11/1977 |
| JP | S57108525 | 7/1982 |
| JP | H0391618 | 4/1991 |
| JP | 2001059618 | 3/2001 |
| KR | 200477877 Y1 | 8/2015 |

OTHER PUBLICATIONS

U.S. Patent and Trademark Office, Office Action issued in U.S. Appl. No. 17/489,993 dated Jan. 4, 2023.

United States Patent and Trademark Office, Notice of Allowance issued in U.S. Appl. No. 17/111,937, 21 pages, dated Sep. 21, 2022.

United States Patent and Trademark Office, Non-Final Office Action issued in U.S. Appl. No. 17/111,937, 30 pages, dated Aug. 1, 2022.

United States Patent & Trademark Office; Notice of Allowance issued in U.S. Appl. No. 17/111,929 dated Mar. 14, 2023.

United States Patent and Trademark Office, Notice of Allowance issued in U.S. Appl. No. 17/489,993, 20 pages, dated Apr. 20, 2023.

United States Patent and Trademark Office, Office Action issued in U.S. Appl. No. 17/111,929, 30 pages, dated Jul. 20, 2022.

BurnerAlert, BurnerAlert Stove Reminder Disc, Amazon.com, Retrieved from:https://www.amazon.com/BurnerAlert-Stove-Reminder-Color-White/dp/B07PP7P9S3, Retrieved on Apr. 6, 2021.

Day, Lewin, Stove Alarm Keeps the Kitchen Safe, Retrieved from: https://hackaday.com/2018/12/09/stove-alarm-keeps-the-kitchen-safe/, Dec. 9, 2018.

Related Applications Transmittal, dated Oct. 8, 2021.

* cited by examiner

MINIMUM IGNITION PERIOD FOR GAS BURNERS

BACKGROUND

Cooking appliances such as cooktops or ranges have a variety of control or selector knobs for adjusting and controlling the amount of heat supplied to various appliance burners or cooking elements. For burners that rely on combustible gas such as natural gas or liquefied petroleum (LP) gas (also referred to as propane), turning a burner control such as a control knob generally causes a gas valve to be opened to supply gas to an associated gas burner, and energizes a switch through the first part of the range of the knob's rotation to spark an igniter in this range of rotation igniting the gas flowing out of the gas valve. In some instances, the control knob may be mechanically coupled to the gas valve such that the relationship between the control knob position and the gas valve position is fixed. Moreover, with such mechanical-type arrangements, a switch that is activated during a predetermined range of a knob's movement such that the igniter is energized only when the knob is in that range.

One concern that arises with appliances, such as cooktops and ranges, is the risk of unintentional opening of the gas valve. Such unintentional incidents may be caused, for example, by the user, a jumping pet, a playing child, and/or someone not aware that they bumped into or otherwise turned the associated control knob. This may occur even though typical burners usually include a two-manual-operation protocol to energize a burner (e.g., pushing and turning of the corresponding control knob). Another concern that may arise is that a user may rotate the knob quickly beyond the range in which the igniter is energized, which may leave the gas valve in an open state with no flame. In some instances, the user may not realize gas is flowing without a flame because the burner is covered by a large pan.

Thus, there is a need to increase control and flexibility with respect to ensuring proper ignition of gas burner. Furthermore, there may be a need to manage the ignition system to improve proper ignition of gas flowing to a gas burner.

SUMMARY

The herein-described embodiments address these and other problems associated with the art by utilizing, for a mechanical-type burner control for a gas burner, a control circuit that is capable of energizing an ignition system for the gas burner for at least a predefined minimum length of time, and regardless of the length of time a burner control is actually in an ignition range. By doing so, even if a user moves the burner control too quickly through the ignition range to properly ignite the burner, the likelihood of a successful ignition is increased due to the increased time in which the ignition system is energized.

Therefore, consistent with one aspect of the invention, a cooking appliance may include a gas cooking element, an igniter disposed adjacent to the gas cooking element to ignite the gas cooking element, a gas valve configured to regulate gas flow to the gas cooking element, a burner control mechanically coupled to the gas valve to vary the gas flow to the gas cooking element, a sensor configured to detect positioning of the burner control in an ignition range of positions, and a control circuit coupled to the igniter and the sensor and configured to activate the igniter in response to detected movement of the burner control into the ignition range of positions, the control circuit further configured to maintain activation of the igniter for a predetermined minimum length of time once activated.

In addition, in some embodiments, the control circuit is further coupled to a timer and further configured to activate the timer when the burner control enters the ignition range of positions, where the timer is set for the predetermined minimum length of time, and deactivate the igniter upon expiration of the timer if the burner control is no longer in the ignition range of positions. In some embodiments, the control circuit is further coupled to a timer and further configured to activate the igniter whenever the burner control is in the ignition range of positions, activate the timer when the burner control enters an operational range of positions, where the timer is set for the predetermined minimum length of time, and deactivate the igniter upon expiration of the timer. Further, in some embodiments, the igniter remains active when the burner control is in the operational range of positions until expiration of the predetermined minimum length of time.

In addition, in some embodiments, the sensor includes a switch that is activated whenever the burner control is in the ignition range of positions, and the control circuit is coupled between the switch and the igniter. Further, in some embodiments, the sensor includes a switch that is activated whenever the burner control is in the ignition range of positions, and the switch is coupled to the igniter in parallel with the control circuit. Some embodiments may further include a flame sensor, and the control circuit is configured to sense a flame using the flame sensor.

Consistent with another aspect of the invention, a cooking appliance may include a gas cooking element, an igniter disposed adjacent to the gas cooking element to ignite the gas cooking element, a gas valve configured to regulate gas flow to the gas cooking element, a burner control mechanically coupled to the gas valve to vary the gas flow to the gas cooking element, a sensor configured to detect positioning of the burner control in an ignition range of positions, and a control circuit coupled to the igniter and the sensor and configured to activate a timer when the burner control enters the ignition range of positions, where the timer is set for the predetermined minimum length of time, and deactivate the igniter upon expiration of the timer if the burner control is no longer in the ignition range of positions.

Further, in some embodiments, the sensor includes an ignition switch that is activated when the burner control is in the ignition range of positions. In some embodiments, the ignition switch sends a low-voltage signal to the control circuit. Moreover, in some embodiments, the control circuit is further configured to detect a direction of movement of the user control and to activate the timer when the direction of movement indicates that the burner control is being turned in a first direction. Some embodiments may further include flame sensor, and the control circuit is configured to sense a flame using the flame sensor.

Consistent with another aspect of the invention, a cooking appliance may include a gas cooking element, an igniter disposed adjacent to the gas cooking element to ignite the gas cooking element, a gas valve configured to regulate gas flow to the gas cooking element, a burner control coupled to the gas valve to vary the gas flow to the gas cooking element, a sensor configured to detect positioning of the burner control in an ignition range of positions, and a control circuit coupled to the igniter and the sensor and configured to activate the igniter whenever the burner control is in the ignition range of positions, activate a timer when the burner control enters an operational range of positions, where the timer is set for the predetermined minimum length of time, and deactivate the igniter upon expiration of the timer.

In addition, in some embodiments, the igniter remains active when the burner control is in the operational range of positions until expiration of the predetermined minimum length of time. Also, in some embodiments, the sensor includes an ignition switch that is activated when the burner control is in the ignition range of positions. Moreover, in some embodiments, the ignition switch sends a low-voltage signal to the control circuit. In some embodiments, the control circuit is further configured to detect a direction of movement of the user control and to activate the timer when the direction of movement indicates that the burner control is being turned in a first direction. Some embodiments may further include a flame sensor, and the control circuit is configured to sense a flame using the flame sensor.

As used herein for purposes of the present disclosure, the term "appliance" should be understood to be generally synonymous with and include any device that consumes electrical power and can be connected to an electrical circuit or battery, for example one used in a residential or commercial setting to accomplish work. The appliances referred to herein may include a plurality of electrically operated components powered by the circuit, the components operable by manipulation of control knobs or selectors. The appliances referred to herein may also include a gas supply or source and one or more gas valves for supplying gas to a burner or heating element. The appliance gas valves may be controlled by a selector or knob, either directly or indirectly, and the appliance may also include a processor or processors that operate, control and monitor the appliance and the various components and functions thereof referred to throughout this specification.

The terms "knob" or "selector" are used herein generally to describe various devices that are operatively coupled to functional components of the appliance and which may typically, but not exclusively, be operated by hand by a user. Typical control knobs and selectors include but are not limited to gas and electric burner controls, gas and electric oven controls, lighting and timing controls, start and stop controls, switches, sliders, pushbuttons, wheels, levers, and various other functional controls associated with an appliance. "Selector" may also be used to refer to a programmed button selection on a touch-screen or similar operator interface.

The term "controller" or "processor" is used herein generally to describe various apparatus relating to the operation of the system and the appliances referred to herein. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), programmable logic controllers (PLCs), and field-programmable gate arrays (FPGAs).

A processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present disclosure discussed herein. The terms "program" or "computer program" are used herein in a generic sense to refer to any type of computer code (e.g., software or microcode) that can be employed to program one or more processors or controllers.

The term "Internet" or synonymously "Internet of things" refers to the global computer network providing a variety of information and communication facilities, consisting of interconnected networks using standardized communication protocols. The appliances, controllers and processors referred to herein may be operatively connected to the Internet.

These and other advantages and features, which characterize the disclosure, are set forth in the claims annexed hereto and forming a further part hereof. However, for a better understanding of the disclosure, and of the advantages and objectives attained through its use, reference should be made to the Drawings, and to the accompanying descriptive matter, in which there is described example embodiments of the disclosure. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. The drawings are not necessarily to scale. Emphasis is instead generally placed upon illustrating the principles of the disclosure, wherein.

DETAILED DESCRIPTION

The embodiments discussed hereinafter will focus on the implementation of the hereinafter-described techniques and apparatuses within a residential type cooking appliance such as a cooking appliance 10 as described below, such as the type that may be used in single-family or multi-family dwellings, or in other similar applications. However, it will be appreciated that the herein-described techniques and apparatuses may also be used in connection with other types of cooking appliances in some embodiments. For example, the herein-described techniques may be used in commercial applications in some embodiments. Moreover, the herein-described techniques may be used in connection with various cooking appliance configurations. Implementation of the herein-described techniques within gas/electric top burners, gas/electric ranges, slide-in ovens, freestanding ovens, gas/electric cooktops, gas/electric countertop ranges, etc. using a gas/electric burner or cooking surface would be well within the abilities of one of ordinary skill in the art having the benefit of the instant disclosure, so the embodiments are not limited to the residential-type range implementation discussed further herein.

Figure 1:
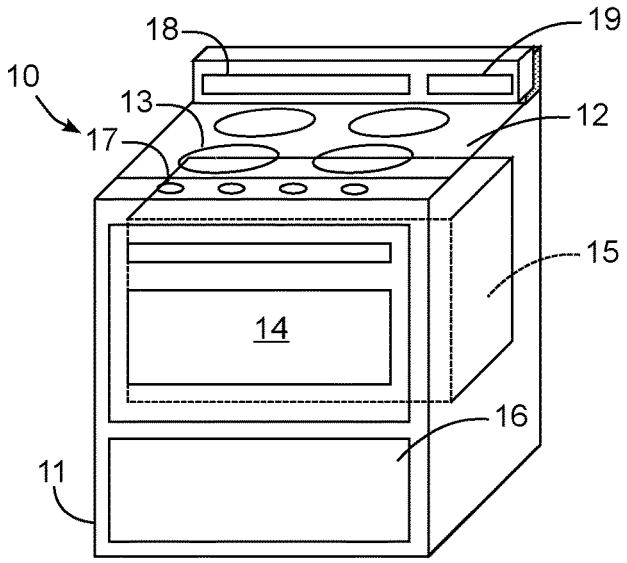
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 11, a stovetop or cooktop 12 including a plurality of burners 13, and an oven 14 defining an oven or cooking cavity 15 accessed via an oven door. Cooking appliance 10 may also include a storage drawer 16 in some embodiments, or in other embodiments, may include a second oven. Various cooking elements (not shown in FIG. 1) may also be incorporated into cooking appliance 10 for cooking food in oven 14, e.g., one or more electric or gas heating elements. In some embodiments, cooktop 12 may include one or more cooking grates (not shown) thereon. The cooking grate may support a cooking vessel or cookware (not shown) over burner 13.

Cooking appliance 10 may also include various user interface devices, including, for example, control knobs 17 for controlling burners 13, a control panel 18 for controlling oven 14 and/or burner 13, and a display 19 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 19 may be touch sensitive to receive user input in addition to displaying status information and/or otherwise interacting with a user. In other embodiments, cooking appliance 10 may be controllable remotely, e.g., via a smartphone, tablet, personal digital assistant or other networked computing device, e.g., using a web interface or a dedicated app.

Display 19 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 may be a range, which combines both a stovetop and one or more ovens, and which in some embodiments may be a standalone or drop-in type of range. In other embodiments, however, cooking appliance 10 may be another type of cooking appliance, e.g., a cooktop without a separate oven. In general, a cooking appliance consistent with the disclosure may be considered to include any residential-type appliance including a housing and one or more cooking elements disposed therein and configured to generate energy for cooking food on a cooktop and/or within one or more oven cavities.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave heating elements in some embodiments, while in the case of a stovetop, one or more cooking elements therein may be gas, electric, or inductive heating elements in some embodiments. Further, it will be appreciated that any number of cooking elements may be provided in a cooking appliance (including multiple cooking elements for performing different types of cooking cycles such as baking or broiling), and that multiple types of cooking elements may be combined in some embodiments, e.g., combinations of microwave and light cooking elements in some oven embodiments.

Figure 2:
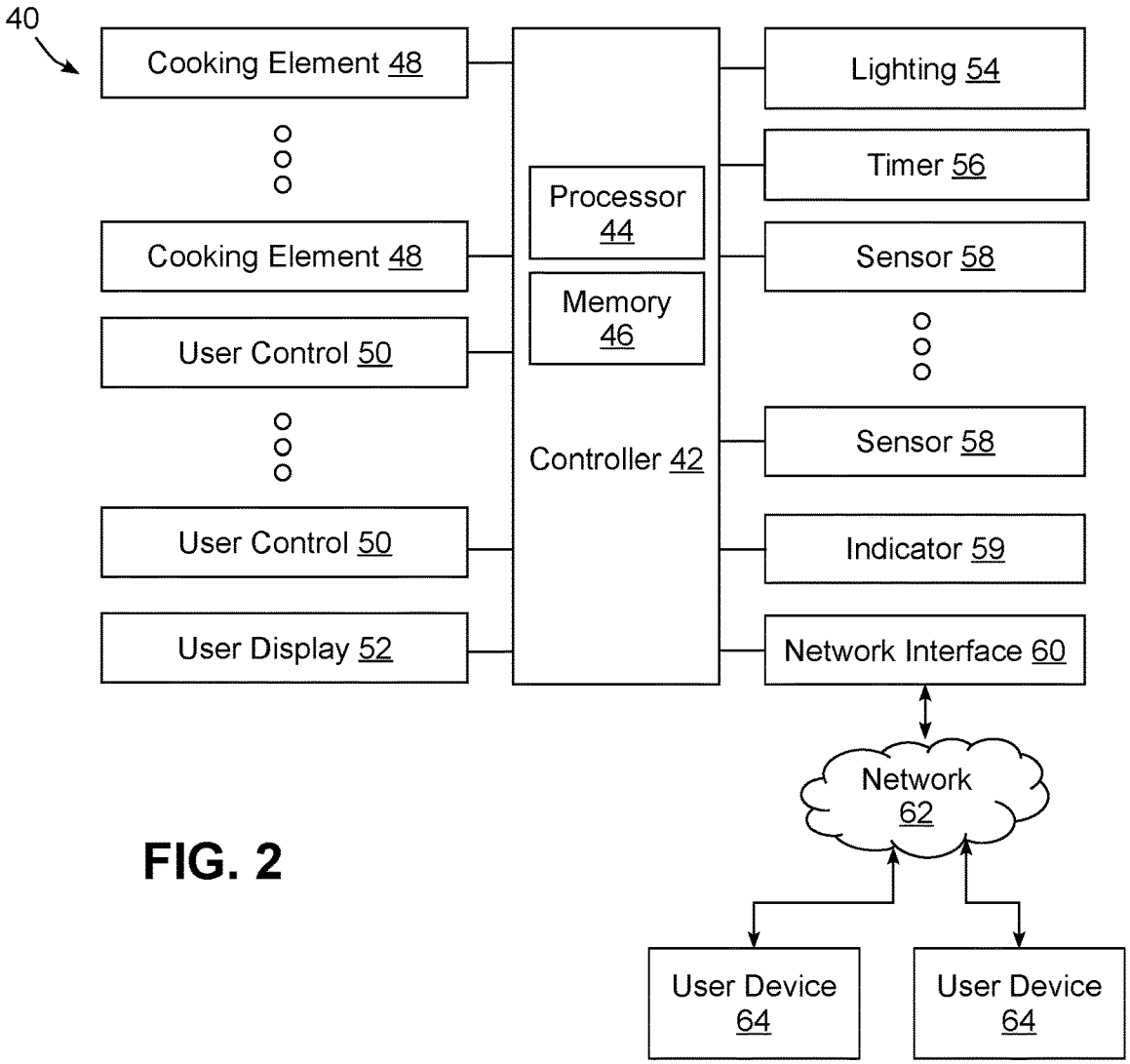
FIG. 2 is a block diagram of an example control system for a cooking appliance consistent with some embodiments of the invention.

A cooking appliance consistent with the disclosure also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42. The processor 44 may be any hardware device capable of executing instructions stored in memory 46 or otherwise processing data. As such, the processor may include a microprocessor, field programmable gate array (FPGA), application-specific integrated circuit (ASIC), or other similar devices. The memory 46 may include various memories such as, for example L1, L2, or L3 cache or system memory. As such, the memory 46 may include static random access memory (SRAM), dynamic RAM (DRAM), flash memory, read only memory (ROM), or other similar memory devices. It will be apparent that, in embodiments where the processor includes one or more ASICs (or other processing devices) that implement one or more of the functions described herein in hardware, the software described as corresponding to such functionality in other embodiments may be omitted.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans (e.g., convection fans, cooling fans, etc.), among others.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments. Sensors 58 may include, for example, one or more temperature sensors for sensing an air temperature within an oven cavity.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback. For example, network interface 60 may include a network interface card (NIC) configured to communicate according to the Ethernet protocol. Additionally, network interfaces 60 may implement a TCP/IP stack for communication according to the TCP/IP protocols. Various alternative or additional hardware or configurations for network interface 60 will be apparent to one of ordinary skill in the art.

In some embodiments, controller 42 may be interfaced with one or more timers 56; the one or more times, for example, may be set for predefined a length of time, as described in detail herein. Such a timer may be a hardware timer or may be a software timer (e.g., implemented in processor 44).

In some embodiments, controller 42 may be interfaced with one or more indicators 59 to signal various conditions of cooking appliance 40 (e.g., energization/de-energization conditions inside of and/or external to cooking appliance 40). For example, indicator 59 may communicate to the user and/or a device that a cooking element has been energized. Indicator 59 may be a variety of signals and/or warnings (e.g., audible/acoustic, visual, light, display message, user interface, haptic alert, or a combination thereof) directed to one or more users or to one or more devices (e.g., appliances, mobile device, cooking appliance, etc.). Indicator 59 may remain continually active until deactivated by the user and/or a certain predetermined parameter/condition of appliance 40 or controller 42 is met. Such indicator 59 may be internal or external to cooking appliance 40 and coupled wirelessly to controller 42 in some embodiments.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the disclosure applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the disclosure is not limited to the particular sequences of operations described herein.

Numerous variations and modifications to the cooking appliances illustrated in FIGS. 1-2 will be apparent to one of ordinary skill in the art, as will become apparent from the description below. Therefore, the disclosure is not limited to the specific implementations discussed herein.

Minimum Ignition Period for Gas Burners

As noted above, one challenge associated with the operation of cooking appliances is the inadvertent operation of burner controls. Embodiments consistent with the disclosure address this challenge in part by establishing a minimum amount of time an ignition system is active, regardless of the amount of time a burner control is in an ignition range. It will be appreciated, for example, that if a burner control is bumped into by a user or pet, one possible scenario that may occur is that the control quickly moves from an off position, completely through the ignition range, and then to a fully on position, potentially in only a fraction of a second, and in all likelihood before sufficient gas flow and sparking could be generated to ignite the burner. As such, by establishing a minimum amount of time an initiation system is active, the gas may be allowed to ignite, even where the burner control was quickly moved through the ignition range, rather than allowing unburned gas to flow into the surrounding environment.

Figure 3:
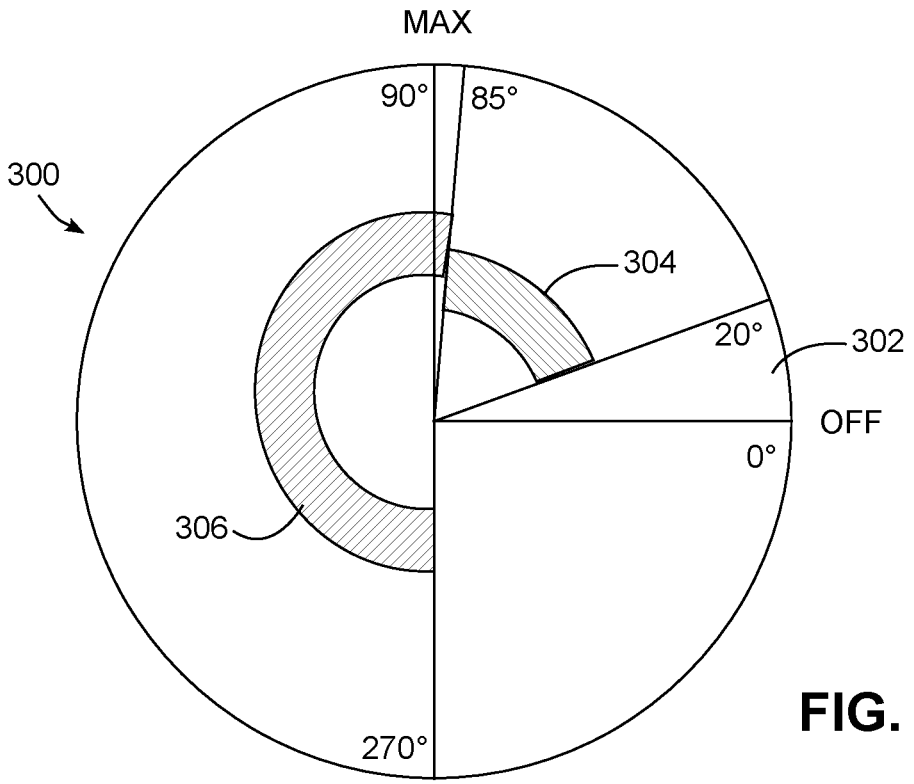
FIG. 3 is a diagram illustrating various positional ranges in the movement of a rotary burner control for a gas cooking appliance.

FIG. 3, for example, illustrates an example relationship of igniter and gas flow positions for an example mechanical gas valve 300 with 270 degrees of rotational range. In some embodiments, for example, a burner control may be movable between multiple ranges of positions. In a first range 302 of positions (generally corresponding to the 0 to 20 degree range in the example of FIG. 3), the igniter is inactive and the gas valve supplies substantially no gas flow to the gas burner. In the second range 304 of positions (generally corresponding to the 20 to 85 degree range in the example of FIG. 3), the igniter is active while the gas valve supplies sufficient gas flow for ignition to occur. In the third range 306 of positions (generally corresponding to the 85 to 270 degree range in the example of FIG. 3), the igniter is inactive while the gas valve continues to supply sufficient gas flow to the gas burner to maintain a flame, generally serving as an operational range where the user is able to regulate an output level of the burner while the burner is active. In some embodiments, the range of positions where the burner control is considered to be on may be considered to be an active range of positions (e.g., range three, or ranges two and three, or some range that at least partially overlaps one or more of ranges two and three). In some embodiments, for example, the active range of positions may be represented by the range of positions in which switch 336 is in an on state (see FIG. 6).

While illustrated in FIG. 3 as a rotary control, it will be appreciated that a burner control consistent with the invention need not be so limited. In other implementations, a linear control (e.g., a slider) may be used, and may have similar ranges of positions as described with reference to FIG. 3.

Figure 4:
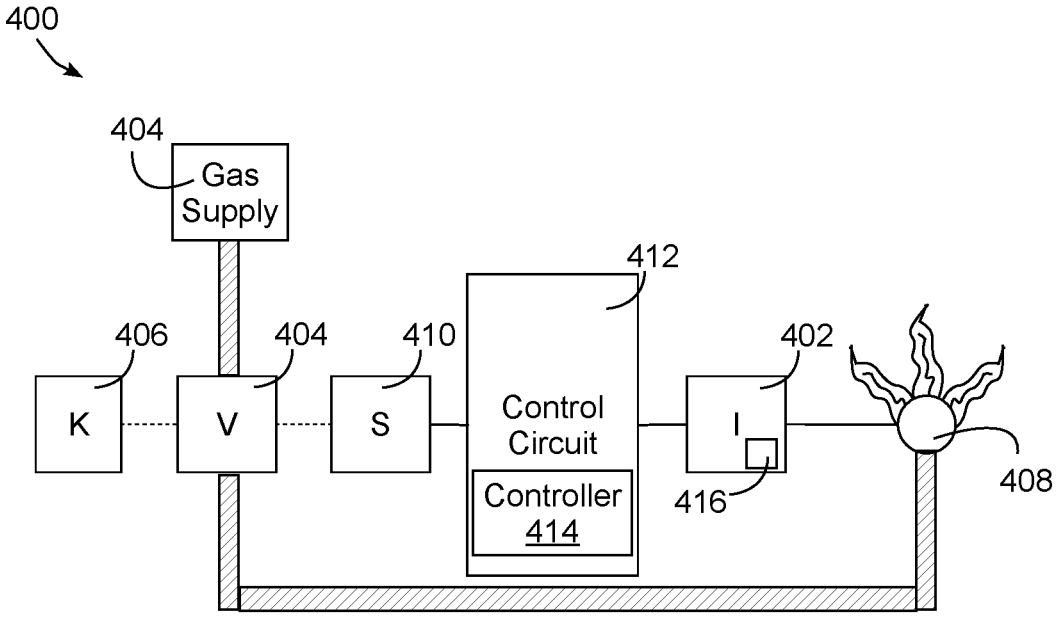
FIG. 4 is block diagram of an example electronic control system for an ignition system consistent with some embodiments of the invention.
Figure 5:
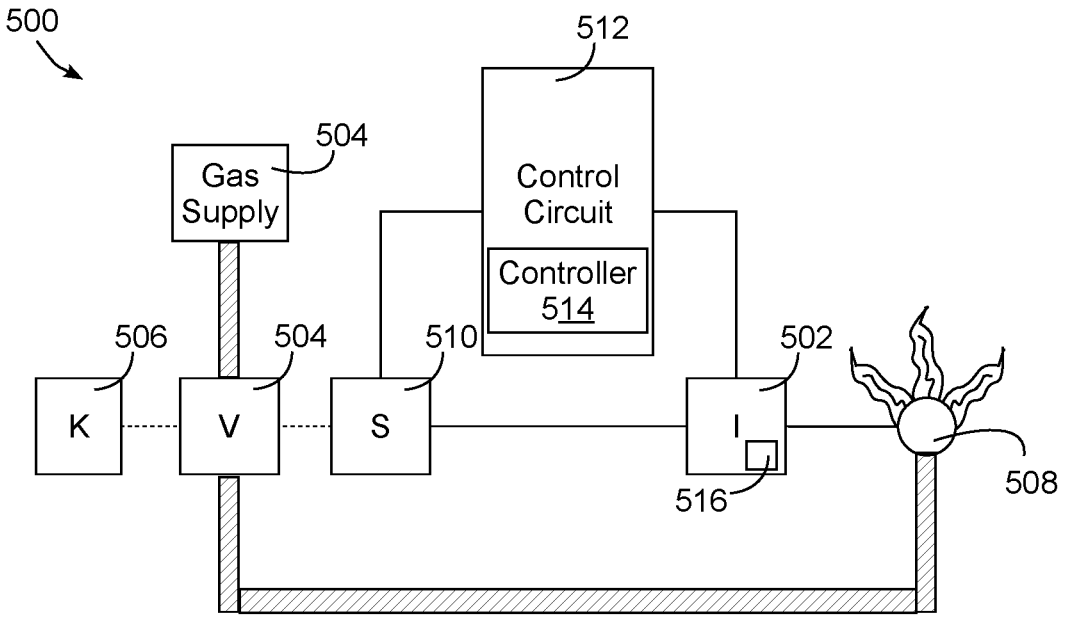
FIG. 5 is block diagram of another example electronic control system for an ignition system consistent with some embodiments of the invention.

FIGS. 4-5 each illustrate an embodiment of an exemplary electronic control system 400, 500 for an igniter 402, 502. This electronic control system 400, 500 may include a mechanical valve 404, 504 that is mechanically coupled (mechanical coupling indicated by broken lines) to a burner control 406, 506, such as a knob or slide. While illustrated for a single burner 408, 508, it is to be understood that similar valves and burner elements may be used for the other cooktop burners of an appliance, but are omitted for clarity. In addition, where a gas oven is incorporated into cooking appliance, one or more gas oven burners, each including an associated mechanical valve and burner element, may also be used.

The electronic control system 400, 500 may further include an igniter switch 410, 510 that is mechanically coupled to the gas valve 404, 504. A control circuit 412, 512 may control the igniter 402, 502 based on the position and timing of the burner control 406, 506, as will be described in detail herein. It will be appreciated that while a controller is discussed in connection with FIGS. 4 and 5, it will be appreciated that various alternate control circuits, whether or not incorporating a controller, microcontroller, processor or other programmable logic, or whether or not incorporating discrete circuit elements, may be used to control an igniter in the manner described herein. Generally, the igniter 402, 502 is activated by an igniter switch 410, 510 that is moved to an on state when a burner control 406, 506 (e.g. a knob) is moved into a certain range of positions, referred to herein as an ignition range of positions. In order to prevent the flow of unburned gas, the igniter switch 410, 510 is generally designed to change state (and thus initiate sparking) just before the point in the gas valve's rotation when gas begins to flow and to remain in this state to allow sparking to continue until just before the valve reaches its maximum flow position. Embodiments consistent with the disclosure herein, seek to provide a minimum time the igniter 402, 502 is active. As mentioned previously, a user may move a burner control 406, 506 (e.g. a knob/slider) through the ignition range (e.g. the second range 304 of FIG. 3) too fast, resulting in a flame not being lit, which may occur, for example, if a burner control is bumped into by a user or pet.

The igniter 402, 502, may by electronically controlled by a controller and may be positioned proximate to gas burner 408, 508 and be configured to ignite gas supplied to the gas burner 408, 508. Through electronic control of the igniter 402, 502, by the control circuit 412, 512, the igniter may remain in an active state, even when the burner control 406, 506 has moved beyond the ignition range (e.g. the second range 304 of FIG. 3) and into the operational range (e.g. the third range 306 of FIG. 3). The igniter 402, 502 may additionally include, in some implementations, an ignition or flame sensor 416, 516 that may be implemented using a flame detector or other suitable technology for detecting when gas burner 408, 508 is ignited and generating heat, and that is coupled to control circuit 412, 512 to enable the controller to detect when a flame has been established.

The control circuit 412, 512 of the electronic control system 400, 500 may be additionally coupled to one or more timers set to a predetermined length of time. Such a timer may be a hardware timer (e.g., a 555 timer, RC network, or similar circuit) or may be a software timer, and may be utilized to decide whether to keep the ignition system active, as described with reference to FIGS. 7 and 8. Control over the cooking appliance may be provided by a control circuit 412, 512, which may include a controller 414, 514 in some embodiments. It will be appreciated that while control circuit 412, 512 utilizes a controller 414, 514 in FIGS. 4 and 5, in some embodiments no controller may be used, with control circuit 412, 414 implemented using only discrete circuit components. In still other embodiments, various functions implemented by control circuit 412, 512 may be implemented using one or both of a controller and discrete circuit components.

In the embodiment illustrated in FIG. 4, the electronic control system 400 is provided in place of conventional control of the igniter 402 (e.g. just switch 410 control) for lighting the gas burner 408, so control circuit 412 is positioned between switch 410 and igniter 402 such that switch 410 is not directly coupled to igniter 402. In contrast, the embodiment illustrated in FIG. 5 may utilize the electronic control system 500 in parallel with switch 510 such that either switch 510 or controller 512 may activate the igniter.

Figure 6:
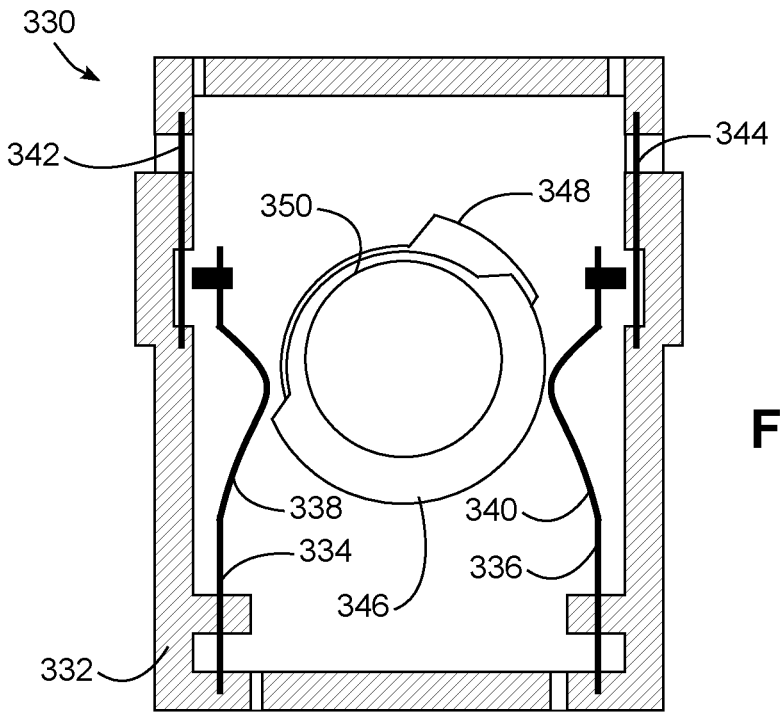
FIG. 6 is a cross-sectional diagram of an example switch configuration for a burner control.

FIG. 6 illustrates an exemplary burner control 330, which includes a housing 332 and a pair of cam-lobe actuated switches 334, 336. Each switch 334, 336 includes a cantilevered leaf 338, 340 biased to a position that is separated from an associated contact 342, 344. A valve stem sleeve 346 may include a pair of cam lobes 348, 350 that are respectively configured to engage leaves 338, 340 to close the switches 334, 336 in the appropriate ranges. Switch 334 may be used, for example, to control the igniter, while switch 336 may be configured to change state at the point gas has begins flowing from the gas valve to the burner (e.g. range 304 in FIG. 3) and remain on throughout the ignition and operational ranges (e.g. ranges 304, 306 in FIG. 3). In some embodiments, switch 336 may be used to control an on indicator for the burner that indicates that the burner control is an on position. Further, in such a two-switch system, a control circuit may determine the directionality of the movement of the burner control based upon the sequence in which the two switches are activated, since when the burner control is turned on, switch 336 will not be activated when switch 334 is initially activated, while when the burner control is being turned off, switch 336 will already be activated when switch 334 is initially activated. Thus, with such a configuration activation of an igniter for a predetermined minimum period of time in some embodiments may be triggered only when turning the burner control in the on direction, such that when a knob is turned rapidly in the off direction, the igniter is not activated for the predetermined period of time.

Switch 334 also functions in the illustrated embodiment as a sensor that is capable of detecting positioning of the burner control in an ignition range. It will be appreciated, however, that other types of sensors, e.g., encoders, hall effect sensors, magnetic sensors, optical sensors, and other position sensors, may be used to detect when the burner control is in the ignition range in other embodiments. Therefore, the invention is not limited to the use of an ignition switch as illustrated in FIG. 6.

Figure 7:
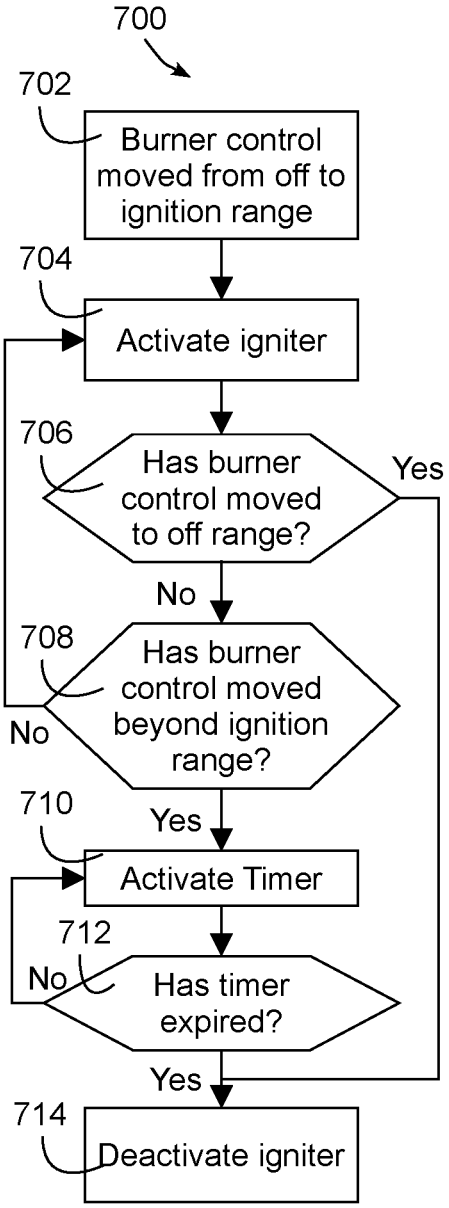
FIG. 7 is a flowchart illustrating an example sequence of operations for maintaining an ignition period and other operational states consistent with some embodiments of the invention.
Figure 8:
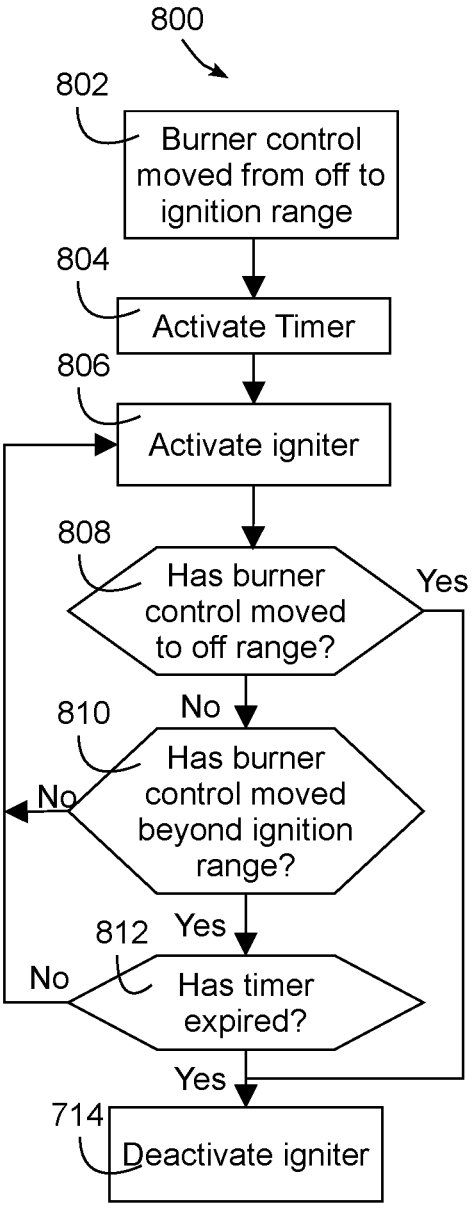
FIG. 8 is a flowchart illustrating another example sequence of operations for maintaining an ignition period and other operational states consistent with some embodiments of the invention.

FIGS. 7 and 8 each illustrate an exemplary sequence of operations 700, 800, each of which may be implemented by either electronic control system 400, 500 described herein. In either configuration of the electronic control system 400, 500 and in either operational sequence 700, 800, the igniter 402, 502 may remain active any time the burner control 406, 506 is in the ignition range. Furthermore, the igniter 402, 502 may be deactivated at any time the burner control 406, 506 is moved to an off position (e.g. the first range 302 in FIG. 3). The control of the igniter 402, 502 only varies when the burner control 406, 506 is moved from an ignition range (e.g. the second range 304 of the FIG. 3) to an operational range (e.g. the third range 306 of FIG. 3).

As shown in FIG. 7, the operational sequence 700 begins in block 702 by a burner control being moved from an off position into an ignition range (e.g. the second range 304 of the FIG. 3). This movement may activate an igniter, at block 704. In particular, this burner control movement may, in some implementations, cause an ignition switch to move into an on state which may result in the sparking of the igniter.

At block 706, the controller may determine whether the burner control has moved to an off range. This may, in some instances, be determined by examining a status of a second switch when the ignition switch transitions to an off state. As described with reference to FIG. 6, the state of a second switch (e.g. switch 336 of FIG. 6) may be used to distinguish between turning the burner on and turning the burner off. In other instances, an encoder or other suitable sensor may be used to determine the directionality of burner control movement. If the controller detects that the burner control was moved to an off range, the igniter is deactivated, block 714. If it is determined that the burner control has not moved to the off range, control may pass to block 708 where it is determined whether the burner control has moved beyond the ignition range.

If the burner control has moved beyond the ignition range, for example into an operational range (e.g. the third range 306 of FIG. 3), a timer may be activated, at block 710. This movement may be detected in some embodiments by again examining a status of a switches 334 and 336, in particular when the ignition switch 334 transitions to an off state while the control state switch 336 remains on. In some instances, the timer may be set for a predetermined length of time in response to movement into the operational range. At block 712 it is determined whether the timer has expired, or in other words if the predetermined length of time has passed. If the predetermined length of time has not passed, the timer remains active. If the predetermined length of time has passed or expired, the igniter is deactivated, block 714.

More simply stated, in the exemplary sequence of operations 700 of FIG. 7 a timer is activated or started once the burner control moves beyond the ignition range and into the operational range. For example, assume the timer is set to a predetermined time of five seconds. In the exemplary sequence of operations 700, the controller has the igniter remain active for five seconds after the burner control moves beyond the ignition range and into the operational range, regardless of the amount of time the burner control was in the ignition range. For example, if the burner control was in the ignition range for one second, the igniter will remain active for five additional seconds, for a total activation time of igniter of six seconds. Conversely, if the burner control remains in the ignition range for six seconds, the igniter will still remain active for five additional seconds, for a total activation time of 11 seconds.

Similar to the sequence of operations illustrated in FIG. 7, the sequence of operations 800 illustrated in FIG. 8 begins in block 802 by a burner control being moved from an off position into an ignition range (e.g. the second range 304 of the FIG. 3). However, unlike the previous implementation, sequence 800 activates a timer 804 and activates an igniter, at block 806 once the burner control is moved into an ignition range. The timer may, in some instances, be set for a predetermined length of time. As discussed previously, the movement of the burner control may, in some implementations, cause an ignition switch to move into an on state which may result in the sparking of an igniter of the igniter.

At block 808, the controller may determine whether the burner control has moved to an off range. This may be determined in the same manner as described with reference to FIG. 7 (e.g. using a second switch or an encoder). If the controller detects that the burner control was moved to an off range, the igniter is deactivated, block 814. If it is determined that the burner has not moved to the off range, control passes to block 810 where it is determined whether the burner control has moved beyond the ignition range.

If the burner control has moved beyond the ignition range, for example into an operational range (e.g. the third range 306 of FIG. 3), a determination may be made regarding whether the timer has expired, or in other words if the predetermined length of time has passed, block 812. If the predetermined length of time has not passed, the timer remains active. If, at block 812, it is determined the predetermined length of time has passed or the timer has expired, the igniter is deactivated, block 814.

More simply stated, in the exemplary sequence of operations 800 of FIG. 8 a timer is activated or started once the burner control moves into the ignition range of operation from an off position. For example, assume the timer is set to a predetermined time of five seconds. In the exemplary sequence of operations 800, the controller has the igniter remain for a minimum of five seconds regardless of how long the burner control is in the ignition range. For example, if the burner control remains in the ignition range for one second, the igniter will remain active for an additional four seconds until the five second timer has expired. However, for example, if the knob stays in the ignition range for six seconds, the igniter will remain active for the full six seconds, but will be deactivated as soon as the burner control is moved out of the ignition range.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed is:

1. A cooking appliance, comprising:
a gas cooking element;
an igniter disposed adjacent to the gas cooking element to ignite the gas cooking element;
a gas valve configured to regulate gas flow to the gas cooking element;
a burner control mechanically coupled to the gas valve to vary the gas flow to the gas cooking element;
a sensor configured to detect positioning of the burner control in an ignition range of positions; and
a control circuit coupled to the igniter and the sensor and configured to:
activate a timer when the burner control enters the ignition range of positions, wherein the timer is set for a predetermined minimum length of time; and
deactivate the igniter upon expiration of the timer if the burner control is no longer in the ignition range of positions.

2. The cooking appliance of claim 1, wherein the sensor comprises an ignition switch that is activated when the burner control is in the ignition range of positions.

3. The cooking appliance of claim 2, wherein the ignition switch sends a low-voltage signal to the control circuit.

4. The cooking appliance of claim 1, wherein the control circuit is further configured to detect a direction of movement of the user control and to activate the timer when the direction of movement indicates that the burner control is being turned in a first direction.

5. The cooking appliance of claim 1, further comprising flame sensor, wherein the control circuit is configured to sense a flame using the flame sensor.

6. A cooking appliance, comprising:
a gas cooking element;
an igniter disposed adjacent to the gas cooking element to ignite the gas cooking element;
a gas valve configured to regulate gas flow to the gas cooking element;
a burner control coupled to the gas valve to vary the gas flow to the gas cooking element;
a sensor configured to detect positioning of the burner control in an ignition range of positions; and
a control circuit coupled to the igniter and the sensor and configured to:
activate the igniter whenever the burner control is in the ignition range of positions;
activate a timer when the burner control enters an operational range of positions, wherein the timer is set for a predetermined minimum length of time; and
deactivate the igniter upon expiration of the timer.

7. The cooking appliance of claim 6, wherein the igniter remains active when the burner control is in the operational range of positions until expiration of the predetermined minimum length of time.

8. The cooking appliance of claim 6, wherein the sensor comprises an ignition switch that is activated when the burner control is in the ignition range of positions.

9. The cooking appliance of claim 8, wherein the ignition switch sends a low-voltage signal to the control circuit.

10. The cooking appliance of claim 6, wherein the control circuit is further configured to detect a direction of movement of the user control and to activate the timer when the direction of movement indicates that the burner control is being turned in a first direction.

11. The cooking appliance of claim 6, further comprising a flame sensor, wherein the control circuit is configured to sense a flame using the flame sensor.

12. The cooking appliance of claim 1, wherein the sensor comprises a switch that is activated whenever the burner control is in the ignition range of positions, and wherein the control circuit is coupled between the switch and the igniter.

13. The cooking appliance of claim 1, wherein the sensor comprises a switch that is activated whenever the burner control is in the ignition range of positions, and wherein the switch is coupled to the igniter in parallel with the control circuit.

14. The cooking appliance of claim 6, wherein the sensor comprises a switch that is activated whenever the burner control is in the ignition range of positions, and wherein the control circuit is coupled between the switch and the igniter.

15. The cooking appliance of claim 6, wherein the sensor comprises a switch that is activated whenever the burner control is in the ignition range of positions, and wherein the switch is coupled to the igniter in parallel with the control circuit.

* * * * *